US005309891A

United States Patent [19]

Savoie

[11] Patent Number: 5,309,891

[45] Date of Patent: May 10, 1994

[54] DIRECT EVACUATION GAS HEATER OR FIREPLACE AND SAFETY RELEASE VALVE FOR SAID HEATERS

[75] Inventor: Ernest Savoie, Bois des Filion, Canada

[73] Assignee: Cheminees Securite LTEE, Quebec, Canada

[21] Appl. No.: 1,516

[22] Filed: Jan. 6, 1993

[30] Foreign Application Priority Data

Jan. 17, 1992 [CA] Canada ..... 2059753

[51] Int. Cl.[5] ..... F24C 03/00

[52] U.S. Cl. ..... 126/85 B; 126/504; 126/512; 126/515; 110/173 B

[58] Field of Search ..... 126/518, 512, 293, 290, 126/289, 515, 516, 517, 500, 504, 307 R, 307 A, 292, 85 B; 110/173 B

[56] References Cited

U.S. PATENT DOCUMENTS

| | | | |
|---|---|---|---|
| 1,588,789 | 6/1926 | Werner | 110/173 B |
| 1,737,732 | 12/1929 | Sauvage | 110/173 B |
| 1,973,997 | 9/1934 | Roberts | 110/173 B |
| 2,038,123 | 4/1936 | Olson et al. | 110/173 B X |
| 2,647,477 | 8/1953 | Martin | 126/307 R |
| 3,410,288 | 11/1968 | Hajek | 110/173 B X |
| 3,668,889 | 6/1972 | Magusson et al. | 126/307 R X |
| 3,693,610 | 9/1972 | Ehrlichmann | 126/307 R X |

FOREIGN PATENT DOCUMENTS

| | | | |
|---|---|---|---|
| 2543266 | 9/1984 | France | 126/517 |
| 1234385 | 6/1971 | United Kingdom | 126/307 |

*Primary Examiner*—Carl D. Price
*Attorney, Agent, or Firm*—Foley & Lardner

[57] ABSTRACT

A direct ventilation gas fireplace having co-linear air intake pipe and gas outlet pipe. The pipes are separated from each other so that the fluid flowing in one pipe does not come in contact with the other pipe. The gas outlet pipe may comprise a safety release valve that allows any excess pressure, in case of explosion, to exit through a lateral spring-actuated door into an enclosure closed around the combustion chamber. This safety release valve allows to build fireplaces having pipes longer than the usual length allowed for respecting specific safety tests in case of gas explosion.

8 Claims, 3 Drawing Sheets

DIRECT EVACUATION GAS HEATER OR FIREPLACE AND SAFETY RELEASE VALVE FOR SAID HEATERS

BACKGROUND OF THE INVENTION

1. Field of the Invention

The invention relates to a direct evacuation gas fireplace having air intake pipe and gas outlet pipe that are co-linear with each other. The invention also relates to a fireplace having a safety release valve so as to prevent damages to the gas outlet pipe in case of explosion.

2. Discussion of the Related Art

Direct evacuation gas fireplaces or heaters comprise a combustion chamber that is separated from its environment by an enclosure. The enclosure is self-contained inasmuch as it communicates only with the exterior of the house through an air intake pipe that allows air to be taken to the combustion chamber and feed oxygen to the fire. A gas outlet pipe to exhaust the gases that are produced exits from the combustion chamber through the enclosure and outside of the house.

In all existing fireplaces of this type, both pipes are concentric to save space.

However, such a manner of construction implies that the gas outlet coming out of the combustion chamber is placed inside the air intake pipe. In this manner, when the incoming air is cold, the exhaust pipe is cooled by the surrounding air and any water vapour produced by the combustion may condense inside the gas outlet pipe. If the air is cold enough, this water may freeze, thereby blocking, at least partially, the gas outlet pipe.

It has now been found that a co-linear exhaust system for direct evacuation gas fireplaces prevents such problems. In addition, this new system allows introduction of an explosion safety release valve in the gas outlet pipe that could not have been introduced when the pipes were concentric. This valve in the outlet pipe and the use of a flexible conduct for air intake pipe, when submitted to an explosion allows for installation of longer than usual pipes without giving up the safety requirements of the Canadian Gas Association safety requirement test.

Particularly, this test called the "Interim 41" requires that the air inlet pipe, the combustion chamber and the gas outlet pipe of the fireplace be filled with an ideal gas mixture that will generate the most violent explosion possible. To pass the test, the pipes and combustion chamber must resist the explosion without any damages or loss of tightness or imperviousness.

SUMMARY OF THE INVENTION

It is therefore a first object of this invention to provide a direct evacuation gas fireplace where condensation and freezing do not occur in the gas outlet pipe.

It is a second object of this invention to provide a safety release valve that can be provided in the gas outlet pipe for preventing blow up when there is an explosion.

It is a third object of this invention to allow installation of longer than usual intake and outlet pipes of this fireplace to ease installation almost anywhere in a house and for preventing blow up when there is an explosion.

The invention therefore provides a direct evacuation gas fireplace or heater. The fireplace comprises a combustion chamber separated from its environment by a closed enclosure. The enclosure has an air intake pipe extending outwardly therefrom, and the combustion chamber has a gas outlet pipe leading outside of the enclosure.

The intake and outlet pipes have portions outside of the enclosure that are co-linear (as the term is used herein) from each other, so that air in the air intake never comes in contact with the gas outlet pipe and gases in the gas outlet pipe never come in contact with the air intake pipe.

Preferably, the gas outlet pipe may comprise a safety release valve positioned adjacent the combustion chamber within the enclosure, this valve being designed for releasing any excess of pressure within the outlet pipe to the enclosure in case gas explosion.

The drawings illustrate embodiments of the invention, in which:

DETAILED DESCRIPTION OF A PREFERRED EMBODIMENT

Of course, it should be emphasizes that the word fireplace as referred to herein also refers to a similar type of heater. Basically, the only difference lies in the fact that a fireplace has a window to permit viewing of the rising flames, whereas a heater has none.

Figure 1:
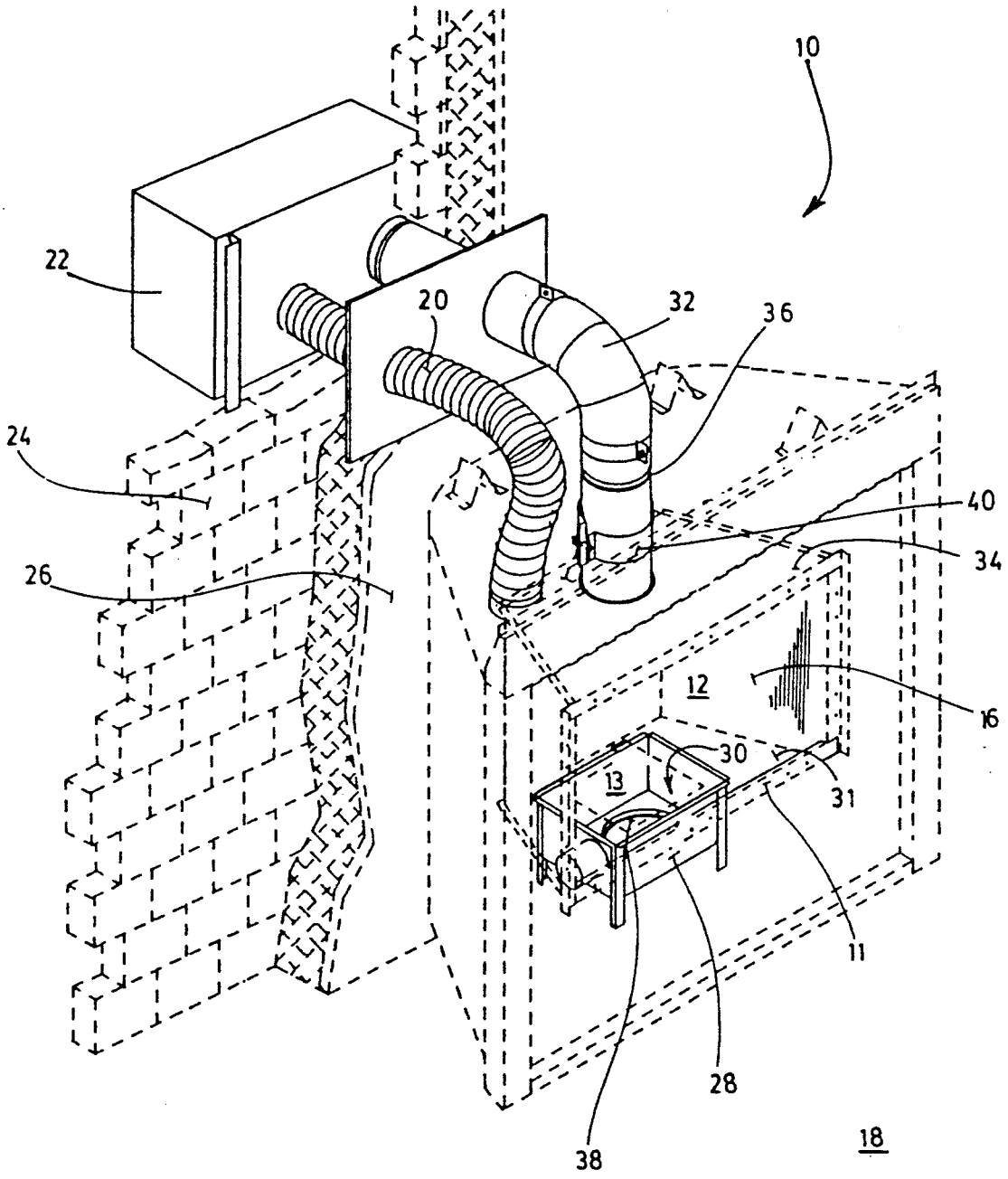
FIG. 1 is a perspective view of a fireplace according to the invention.

FIG. 1 shows a fireplace 10 having a combustion chamber 11 consisting of an upper portion 12 and a lower portion 13 that are surrounded by a closed enclosure 14. The upper portion of the combustion chamber 12 is hermetically shut by a glass door 16 that separates it completely from the inner house environment 18 making it a self-contained system.

The lower combustion chamber 13 comprises a rack 28 that is positioned below an aperture 30 provided in the bottom 31 of the upper combustion chamber 12. This rack 28 is provided with gas inlet means and pilot flame as known in the art. The gas inlet means should be controlled by controlling means known in the field.

The combustion that takes place in the combustion chamber 12 and 13 is fed in oxygen by an air intake pipe 20, which starts at the exterior exit of the house 22 travels through the adjacent walls 24 and 26, enters the enclosure 14 and is connected (not shown) with rack 28 through inlet 100.

The combustion gases produced by the combustion of the propane or natural gas in the combustion chamber 12 & 13 are exhausted through a gas outlet pipe 32 that travels from the roof 34 of the upper combustion chamber 12, hermetically through the enclosure 14, penetrates through the adjacent walls 24 and 26 and exits at the exterior exit 22 of the house.

The junction between the gas outlet pipe 32 and the top of the enclosure 14 should be provided with a seal 36 so that the enclosure is perfectly hermetical with respect to its environment.

Of course, since the gas that flows through the air intake 20 is cold and the gases that travel through the gas outlet 32 are hot, the material used for both these pipes will be different. As such, the material used for the air intake 20 can be thinner and less insulated since the air temperature will be moderate. The gases being hot, the gas outlet pipe 32 will have to be made from more heat resistant material, insulated and thicker, hence less resilient and more susceptible to blow up upon an increase in pressure.

To protect the system against a sudden rise in pressure caused by an explosion, the rack 28 of the lower combustion chamber 13 may be provided with a safety release valve 38. This valve 38 is constituted of a spring-actuated door that opens up when there is a blow. Such doors are already available on a variety of direct ventilation gas fireplaces and are not the object of the present invention. However, this valve 38 is not sufficient to protect the pipes when there is a blow. That is why all existing fireplaces of this type must have pipes that are no longer than 18 inches, if they are to answer to the "Interim 41" safety test of the Canadian Gas Association.

When the pipes are concentric like they are in conventional fireplaces, additional safety provisions can not be added to the pipes. However, with co-linear pipes in accordance with the invention, it is possible to provide a safety release valve 40 to the outlet pipe 32. This valve 40 stops the blow at an early location in the pipe 32 and brings the pressure in the pipe 32 back to atmospheric pressure. This is done by providing a safety release valve 40 in the portion of the pipe 32 that is adjacent the combustion chamber 12, inside the enclosure 14.

Figure 2:
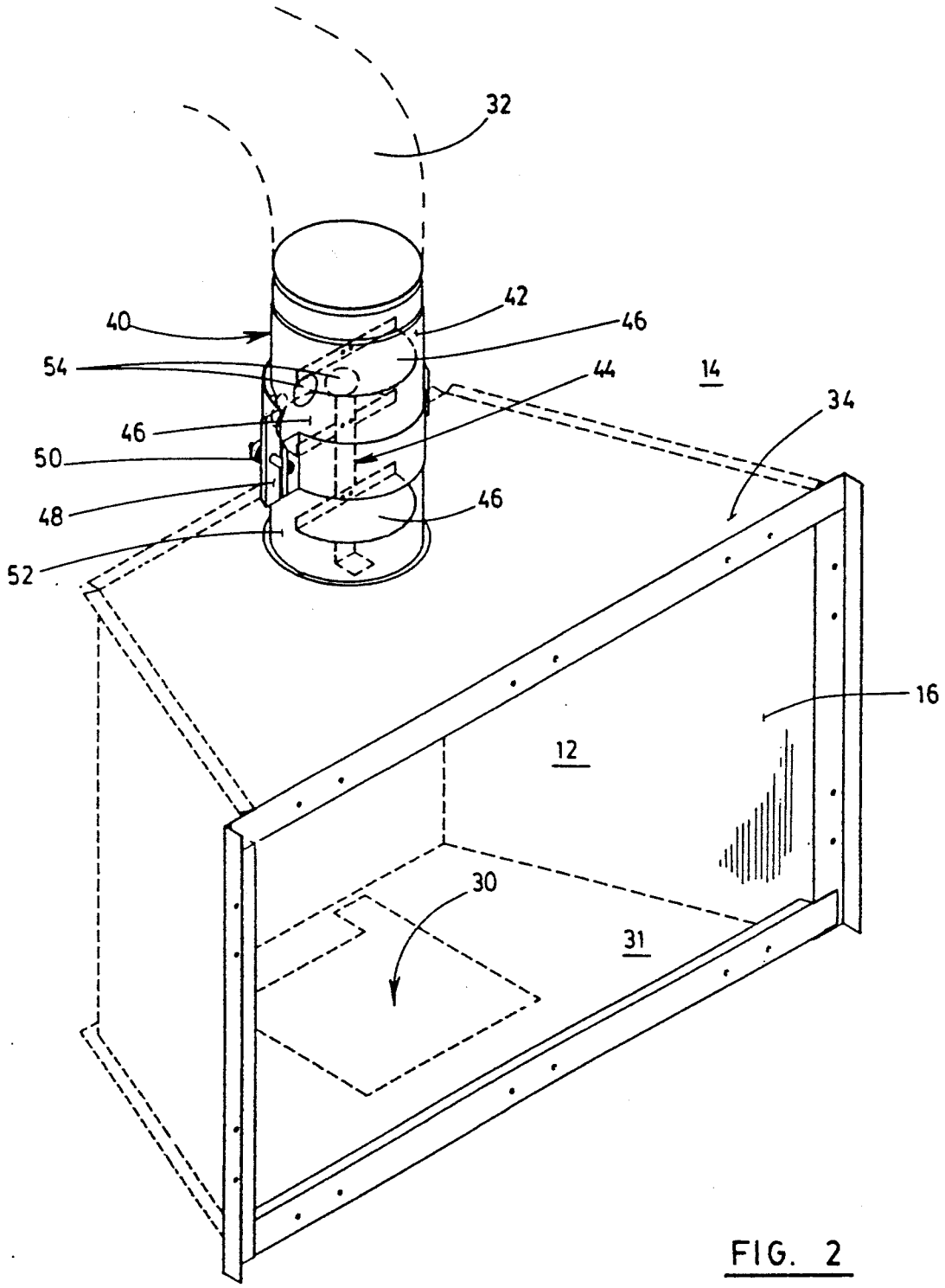
FIG. 2 is a perspective view of the upper portion of the combustion chamber of the fireplace including a portion of the gas outlet provided with the safety release valve of the invention.

As shown in FIG. 2, the valve 40 is made from a cylinder 42 that is preferably the same diameter as the outlet pipe 32 and is inserted between the roof 34 of the upper combustion chamber 12 and the top of the enclosure where the outlet pipe 32 begins. The cylinder 42 should be of the same length or shorter than the distance separating the top of the combustion chamber 34 and the top of the enclosure (not shown) so that the valve 40 is located in the enclosure 14 or at least the door of the valve opens up inside the enclosure 14.

The valve 40 comprises baffle means 44 that block the flow of air longitudinally. Preferably, the baffle means 44 are constituted by a series of baffle plates 46 that are positioned alternatively on each side of the inner cylinder 42 and deviate the flow of gas from its longitudinal course. When the gases are at atmospheric pressure, the flow is slightly deviated but the effect is not noticeable on the wall of the pipe. However, upon a sudden raise in pressure in the outlet pipe 32, the flow is stopped by the baffle plates 46 and tends to burst radially. To prevent the cylinder 42 from bursting, a portion of it is provided with a spring-actuated door 48 that closes one or a series of openings provided in the cylinder's wall 52. The door is held securely and tightly in place when the pressure is atmospheric. Upon a sudden raise in pressure, the springs 50 retaining the door will be pushed and the door 48 will separate from the wall 52 of the cylinder 42 opening up the openings 54. The flow of air will exit through the opening(s) 54 provided in the cylinder wall 42.

Figure 3:
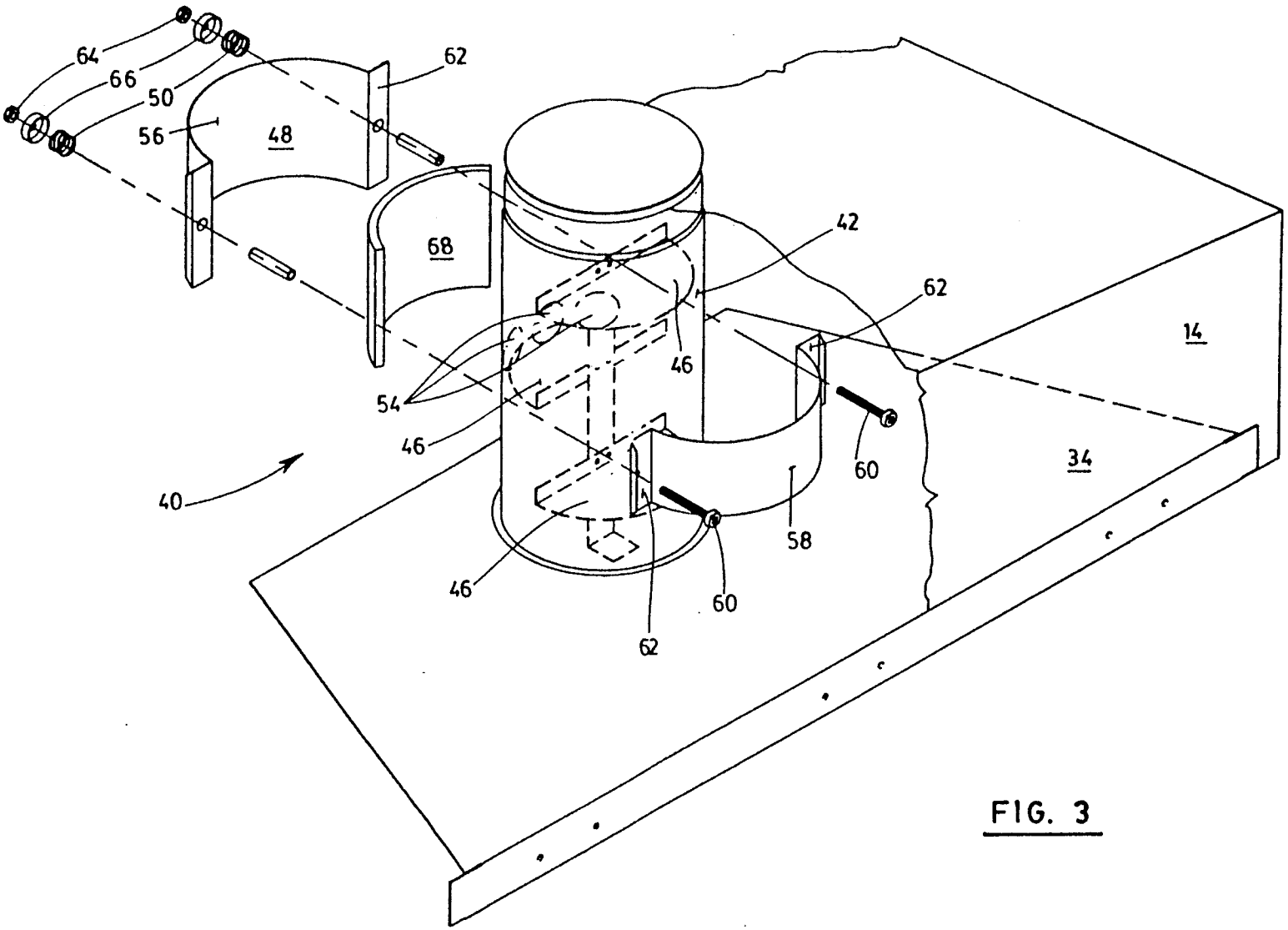
FIG. 3 is an exploded perspective view of the safety release valve of the invention.

As shown in FIG. 3, the door 48 of the safety release valve 40 may be made by the reunion of two semi-circular metal bands 56 and 58 that are sized and positioned to fit tightly around the periphery of the cylinder 42 over the openings 54 and shut them hermetically. Both bands 56 and 58 are secured to each other by bolts 60 that are fastened in holes provided in lateral ears 62 bent outwardly from both ends of each band 56 and 58, these bolts being spring-actuated by passing a spring 50 between the bolts 60 and the nuts 64. These springs may be secured in place by placing a cap 66 before the nut 64.

Of course, the openings 54 in the cylinder 42 may be provided only on one side so that only one band 56 has to be mobile. Therefore, the other band 58 may be secured directly to the cylinder 42. To insure sealing, the mobile band 56 may be lined with a second semi-circular insulating fiber felt 68 placed on top of the opening(s) 54.

Upon explosion, a shock wave will eventually travel through the air intake pipe 20. Because this pipe 20 carries air of moderate temperature, it can be made of an expanding material so that another safety release valve is not necessary. As an example, this pipe may be made of material that may expand upon a raise in pressure, such material being commercialized for example under the trademark BOFLEX or MAGNAFLEX. This provides an extra security measure to ensure that the system remains intact after an explosion. The present invention provides a system against explosion that is efficient in the "Interim 41" test of the CGA. The position of the safety release valve permits the gas outlet pipe and the air inlet pipe to be elongated to length much greater than 18 inches.

As examples, fireplaces having air intake pipes and gas outlet pipes of 2 feet, 9 feet and even up to 12 feet have been manufactured withstanding the explosion. The length of these pipes allows this new fireplace or heater to be positioned almost anywhere in a house without needing to be positioned close to an external wall.

Of course, it will be appreciated that the safety release valve 40 does not have to be in the form of a cylinder. It can be box-shaped, etc., as long as it has lateral opening(s) shut by a spring actuated door.

The embodiments of the invention for which an exclusive right of property or privilege is claimed are defined as follows:

1. A direct evacuation heater comprising:

(a) a combustion chamber;

(b) a closed enclosure separating the combustion chamber from its environment;

(c) an air intake pipe and a gas outlet pipe connected to and leading outside of said enclosure, wherein said intake and outlet pipes have portions outside of said enclosure that are separate from each other so that air in said air intake pipe never comes in contact with said gas outlet pipe and gas in said gas outlet pipe comes in contact with said air intake pipe; and (d) a safety release valve positioned adjacent said combustion chamber within said enclosure, said valve releasing excess pressure within said outlet pipe to said enclosure in case of gas explosion; wherein said safety release valve comprises at least one lateral opening provided in said outlet pipe, a spring-actuated door peripheral to said gas outlet pipe closing said opening, said door being hermetically shut when pressure in said pipe is substantially atmospheric and opening upon a sudden raise in pressure.

2. A heater according to claim 1, wherein said safety release valve further comprises baffle means positioned inside said gas outlet pipe adjacent said combustion chamber for blocking substantially longitudinal expansion of gas during explosion so as to facilitate lateral exit of said pressure through said peripheral door.

3. A heat according to claim 2, wherein said baffle means comprises at least two baffle plates positioned on opposite sides of an inner diameter of said pipe so as to deviate longitudinal expansion of said gases when exploding.

4. A heat according to claim 1, wherein said spring actuated door comprises at least one semi-circular band sized and positioned to fit tightly around said outlet pipe so as to shut hermetically said at least one opening, at least one spring-actuated bolt securing said band to said pipe so as to resiliently detach said band from said pipe and open said at least one opening upon a sudden raise in pressure in said outlet pipe.

5. A heater according to claim 1, wherein at least one portion of said air intake pipe is made of substantially resilient material so as to partially absorb any sudden change in pressure in said enclosure.

6. A heater according to claim 1, wherein said air intake pipe is made of substantially resilient material so as to partially absorb any sudden change in pressure in said enclosure.

7. A heater according to claim 1, wherein said air intake and gas outlet pipes have a length greater than 2 feet.

8. A heater according to claim 1, wherein said air intake and gas outlet pipes have a length greater than 9 feet.

* * * * *